United States Patent [19]

Gustavsson et al.

[11] 4,402,253

[45] Sep. 6, 1983

[54] LOADING PENDULUM

[75] Inventors: Olle Gustavsson; Göran Sundmar, both of Karlskoga, Sweden

[73] Assignee: Aktiebolaget Bofors, Bofors, Sweden

[21] Appl. No.: 217,638

[22] Filed: Dec. 18, 1980

[30] Foreign Application Priority Data

Dec. 18, 1979 [SE] Sweden ..... 7910440

[51] Int. Cl.[3] ..... F41F 9/04

[52] U.S. Cl. ..... 89/46

[58] Field of Search ..... 89/45, 46, 47

[56] References Cited

U.S. PATENT DOCUMENTS

| | | | |
|---|---|---|---|
| 2,781,696 | 2/1957 | Shonts et al. | 89/45 |
| 2,788,713 | 4/1957 | Even | 89/45 |
| 3,927,598 | 12/1975 | Eriksson | 89/45 |

*Primary Examiner*—Stephen C. Bentley

*Attorney, Agent, or Firm*—Pollock, Vande Sande & Priddy

[57] ABSTRACT

A loading pendulum is arranged at the rear of one side of a firearm suspended in an elevating mass. The loading pendulum has two arms which can be swung in the traversing direction of the firearm, the first ends of which are supported for co-ordinated driving by means of drive shafts (13, 14) which are parallel to each other and, when the pendulum adjusts itself to the angle of elevation or depression of the firearm extend at right angles to said traversing plane, and second ends support a loading tray (10) in supporting shafts (15, 16) also at right angles to the traversing plane when the pendulum adjusts itself to the angle of elevation or depression of the firearm. The arms (11, 12) are arranged to achieve a position swung to the side and a swung-in position of the loading tray which moreover in a feeding position, which can differ as regards the angle of elevation or depression from said position when swung to the side, is arranged to receive an ammunition unit (30) from a loading table or the like and which is arranged to make it possible to swing in the ammunition unit to the extension of the axis of the bore of the firearm, with which the loading tray coincides at the swung-in position. Said arms have different lengths, and are arranged so that in the feeding position they will hold the loading tray obliquely. An ammunition unit which with its front ends extends at the front of the loading tray will then extend with said front parts at the side of the elevating mass.

10 Claims, 4 Drawing Figures

LOADING PENDULUM

TECHNICAL FIELD

The present invention relates to a loading pendulum which can be applied at one side of a firearm suspended in an elevating mass. The loading pendulum is then arranged to support a loading tray on two arms which can swing in the traversing plane of the firearm. The loading tray can be swung sideways from a side position which the pendulum assumes when it has adjusted itself to the angle of elevation or depression of the firearm, after having received an ammunition unit from a feeding position, to a swung-in position in the extension of the axis of the bore of the firearm, and vice versa. The arms also support the loading tray in supporting points at their first ends. At their second ends they are connected to the respective one of two drive shafts which, when the pendulum assumes said angle of elevation or depression, extend at right angles to the traversing plane and can be actuated from driving means which give co-ordinated driving movements for the arms.

As an example of a firearm may be mentioned a large-calibre artillery piece, e.g. a field howitzer.

BACKGROUND ART

For a field howitzer it is previously known to utilize a loading pendulum which is supported around the trunnion center of the firearm, and which also supports a loading tray which can be swung sideways. The loading pendulum is then arranged so that in a side position of the loading tray it is adjustable to a level with a loading table or the like for receiving an ammunition unit, e.g. a shell, which is rolled down sideways into the loading tray supported by the loading pendulum. After having received the ammunition unit the loading pendulum adjusts itself to the prevailing angle of elevation, after which the loading pendulum is arranged to swing in the loading tray laterally to a swung-in position in the extension of the axis of the bore of the firearm, so that the shell lies along the extension.

A loading pendulum of this kind is made with a loading tray which can be swung in from the side, in order to save space behind the firearm.

DISCLOSURE OF THE INVENTION

Technical Problem

Although it has been possible for the loading pendulum and the associated loading tray to work in the recoiling space for the firearm behind the breech ring, hitherto known arrangements of the loading pendulum and loading tray have required access to comparatively ample space behind the firearm, particularly if the ammunition with which firing is to take place is comparatively long, e.g. up to approx. 1000 mm. This, in the case of a field howitzer, has made firing at high elevations difficult, and it should be possible to fire at elevations as high as 70°.

Summary of the Invention

The purpose of the present invention is to create a loading pendulum which requires comparatively little space behind the firearm. The arms of the pendulum are arranged so that in the feeding position they will support the loading tray so that, when viewed from its rear parts, it will be inclined obliquely outwards in relation to a vertical plane through the axis of the bore to permit an ammunition unit to be placed in the loading tray, and which has its front parts extending out in front of the loading tray, extend with the front parts at the side of and outside the elevating mass.

In further development of the invention improvements are proposed as to the detailed design and arrangement of the arms in relation to the firearm, and the arrangement for the co-ordinated driving of the arms.

However, the features that can mainly be considered to be characteristic for a loading pendulum according to the invention will be noted from the claims.

Through the invention, because of the movement geometry of the loading tray, it will be possible to guide the front section of the shell into the breech ring and chamber in the barrel. In this way, space is saved behind the weapon of between 200 and 600 mm, as the swinging movement of the loading tray can be increased. This, in turn, permits the height of the axis of the bore to be kept low, and the weapon can be set at comparatively higher angles of elevation for firing.

Through the invention, consideration is given to a comparatively technically simple but nevertheless well functioning design of the loading pendulum.

BRIEF DESCRIPTION OF DRAWINGS

An embodiment of a loading pendulum which has the characteristics of the invention will be described in the following, with reference in more detail to the accompanying drawings, in which FIG. 1 in a side view shows the loading pendulum without loading tray and arranged at a firearm in the form of a field howitzer, FIG. 2 in a horizontal view shows the loading pendulum according to FIG. 1, with the loading tray shown in principle, FIG. 3 in a horizontal view and in principle shows the pattern of the movement of the arms of the loading pendulum, the loading tray fastened to the arms, and also the front parts of a shell applied in the loading tray, and FIG. 4 in a side view and in principle shows the positions of said front parts of the shell at angles of elevation of 0° and 70° and in relation to the elevating mass.

BEST MODE OF CARRYING OUT THE INVENTION

Figure 1:
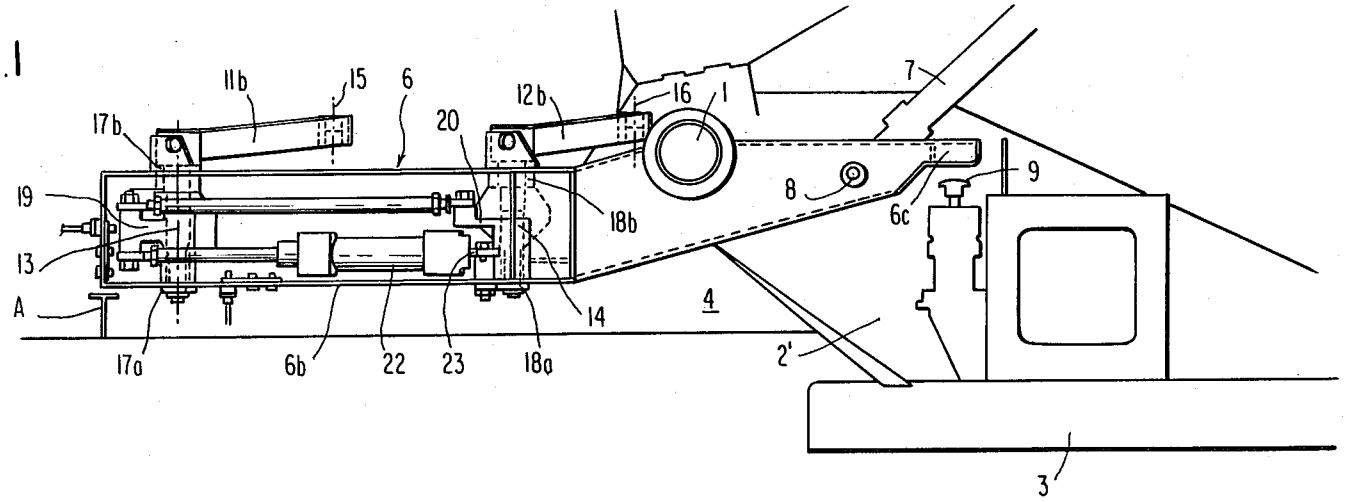
Figure 2:
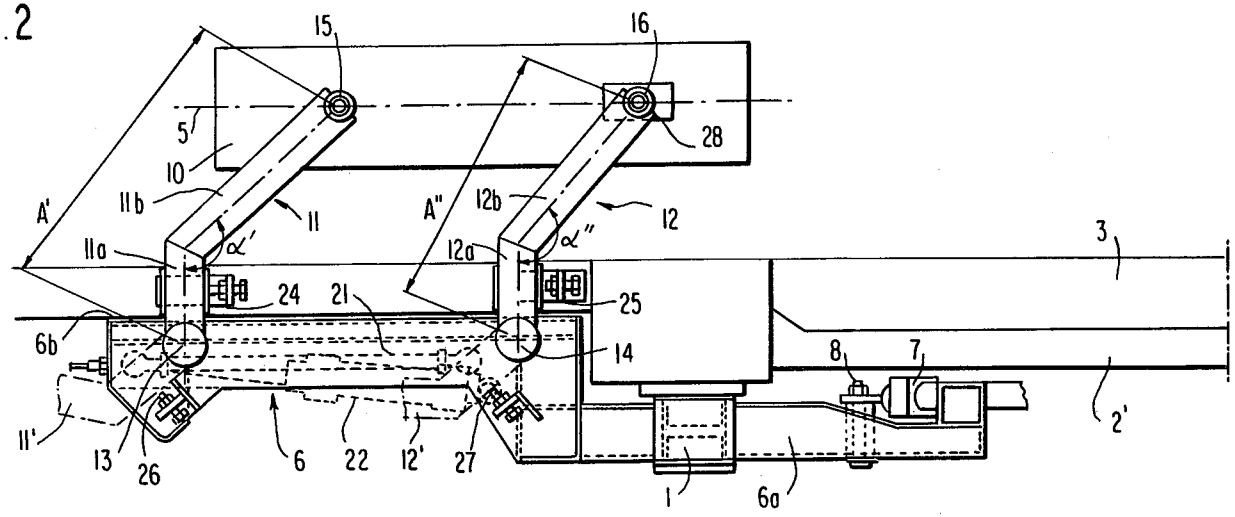

In FIGS. 1 and 2, the trunnion on a field howitzer is indicated by the numeral 1. In a way which is known, the trunnion is arranged in a cradle carrier, one part of which is shown by 2'. The cradle carrier is arranged on an upper mounting 3 which also in a way which is known in itself is rotatable laterally in order to enable a traversing movement of the elevating mass 2 which comprises a gun supported in the cradle carrier, and the breech ring of which is indicated by 4 in FIG. 1. The extension of the axis of the bore of the firearm is shown by 5.

A loading pendulum 6 is rotatably supported in a way which is known in itself on the trunnion 1, so that from a starting position, e.g. the horizontal position according to FIG. 1, which is utilized as a feeding position, it can swing in and adjust itself to the prevailing angle of elevation or depression of the firearm. The loading pendulum comprises a frame with a front frame part *6a*, via which the pendulum is supported on the trunnion 1, and a rear frame part *6b*. The first and second frame parts then mainly have the form of box girders. The front part of the frame extends to the outside of the cradle carrier part 2', while the rear frame part 6b is angled, and extends in the transversal direction of the weapon at the rear side of the cradle carrier part and thereafter parallel to the breech ring and the cradle of the firearm and is displaced parallelly in relation to the front frame part 6a.

At its front parts, the pendulum is connected to an operating cylinder 7, rotatably via a supporting journal 8. For determining the maximum depression position, the pendulum is made with a front section 6c which can coact with a spring stop 9 on the cradle carrier. The rear frame part 6b can coact at various angles of elevation with a stop A on the elevating mass.

The loading pendulum is arranged to support the loading tray indicated by 10 in FIG. 2 on two arms 11 and 12 supported in the rear frame part 6b. Each of said arms comprises two angular parts, of which the first angular part is designated 11a and 12a, respectively, and the second angular part is designated 11b and 12b, respectively. The angular parts of the respective arm are arranged with different angles $\alpha'$ and $\alpha''$, the angle $\alpha'$ being less than the angle $\alpha''$ (approx. 135° and approx. 140°, respectively).

The first angular parts 11a and 11b, respectively, of the two arms are moreover substantially of the same length, while the part 11b on the rear arm is longer than the part 12b on the front arm.

Each arm is via the free end of the first part connected to a drive shaft 13 and 14, respectively. The two drive shafts are arranged parallel to each other and at right angles to the traversing plane of the firearm when the loading pendulum is set at the angle of elevation or depression of the firearm. The arms are via the free ends of the second parts 11b and 12b connected to supporting shafts 15 and 16, respectively, to which the loading tray 10 is connected. Also the supporting shafts 15 and 16 are parallel to each other and at right angles to said traversing plane when the loading pendulum is set at the angle of elevation or depression of the firearm. Through the design described above of the arms, a shortest distance A' and A'', respectively, obtained on the respective arm between the shafts 13 and 15, and 14 and 16, respectively, will be of different lengths, and A' will moreover be longer than A''. The difference between A' and A'' can then vary between 10 and 50 mm, particularly between 20 and 40 mm. A preferable value of said difference in the present case is approx. 25 mm.

The drive shafts 13 and 15 are supported in the rear frame part 6b in bushing holders 17a, 17b, and 18a, 18b, respectively, fastened in the rear frame part. Carriers 19 and 20, respectively, are connected to the respective drive shafts. The drive shafts are connected to each other by means of a tie rod 21, the first end of which is connected to the carrier 19 and the second end of which is connected to the carrier 20. Also the piston of an operating cylinder 22 is connected to the carrier 19. The second end of the operating cylinder is fastened to the cradle part 6b in a supporting point 23.

Through the above-mentioned arrangement, the movements of the drive shafts 13, 14 will be coordinated with each other. The movements of the operating cylinder 22 are transmitted to the carrier 19, which turns the drive shaft 13, and also pulls along the tie rod 21 which, in turn, turns the drive shaft 14. The carriers and the tie rod are then arranged so that the turning angles (the rotating speeds) will be equal on the two drive shafts.

Figure 3:
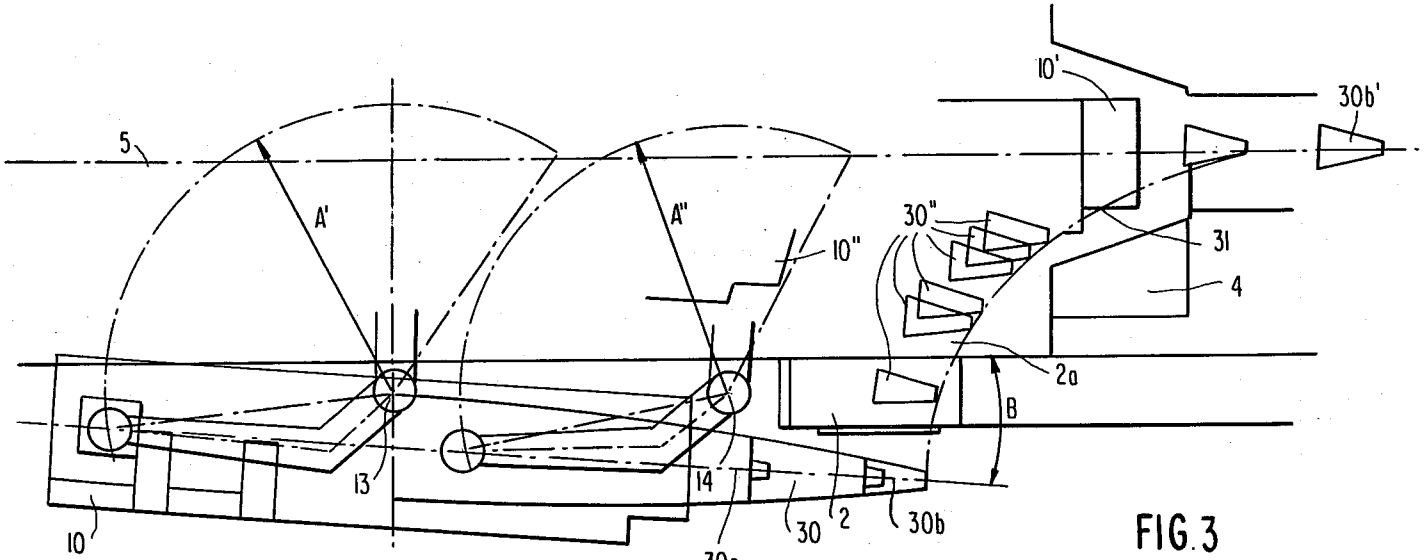

The operating cylinder 22 can then guide the arms so that the loading tray is turned between a position swung to the side, as shown by FIG. 3, and a swung-in position at which, according to FIG. 2, the center line of the loading tray and also the supporting shafts 15 and 16 coincide with the extension 5 of the axis of the bore of the firearm. The positions are defined between first stops 24 and 25, respectively, which determine the swung-in position, and second stops 26 and 27, respectively, which determine the position swung to the side, which is indicated by arms 11' and 12', respectively, drawn with dot-dash lines.

Owing to the fact that the drive shafts 13 and 14 turn with the same speed and the arms are of different lengths, the supporting point 16 for the front arm in the loading tray can be displaced longitudinally, which is indicated by an elongate recess 28 in the bottom of the loading tray. In principle, the supporting point 15 can instead be longitudinally displaceable. The support in the loading tray which cannot be displaced longitudinally is rotatably supported with a conventional rotatable support. Also the second rotatable support can be made in a conventional way, which is known in itself.

In the example of the embodiment shown, the first angular parts 11a and 12a, respectively, on the two arms, are set parallel to the swung-in position of the loading tray according to FIG. 2. In the position swung to the side according to FIG. 3, the two arms extend substantially straight rearwards. The two drive shafts 13, 14 are located in a vertical plane parallel to a vertical plane (=the plane at right angles to the plane of the paper in FIG. 3) through the axis of the bore.

Further, the arms have such a design that in the side and feeding position the loading tray 10 is set obliquely so that in relation to a vertical plane through the axis 5 of the bore when the firearm is set up on a horizontal base it is inclined from its rear parts and outwards in its horizontal plane. Further, the oblique positioning is such that the rear parts of the loading tray 10 adapt themselves to a parallel line 29 which in the horizontal plane according to FIG. 3 is in a vertical plane which is parallel to the vertical plane through the axis 5 of the bore. The line 29 comprising the vertical plane then extends along an inner surface 2a of the elevating mass 2. In FIG. 3, the nose section of a shell applied in the loading tray is indicated by 30, with which nose section the shell extends outside the front end of the loading tray. The loading tray then supports the shell in such a way that the nose section is on the outside of the elevating mass 2. A longitudinal axis 30a of the shell and the line 29 comprising the vertical plane then forms an angle $\beta$ which is between 2° and 10°, particularly approx. 5°. The drive shaft 14 is moreover just behind said cradle carrier part 2'.

During the lateral swinging-in of the loading tray with the loading pendulum after this has adjusted itself to the angle of elevation of the firearm after having received a shell, the point 3b of the shell will follow an arced line 31 until it has reached the swung-in position 30b' in connection with the axis of the bore. In FIG. 3 a number of intermediate positions of said point are indicated by 30b''. Also the loading tray is shown in its position coinciding with the axis of the bore, for which the designation 10' has been used. The loading tray is also shown in an intermediate position 10''. In addition to the lateral movement of the loading tray, this also receives a movement forwards in the longitudinal direction of the firearm during the swinging-in.

Figure 4:
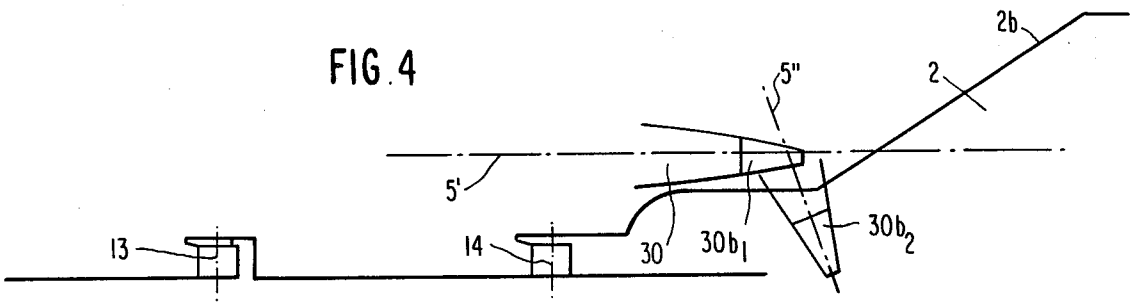

FIG. 4 is intended to show an advantage obtained by the invention. The upper line of the elevating mass 2 is indicated by 2*b*. The axis of the bore of the elevating mass is indicated by 5', which is also the centre line of the shell at 0° elevation. 5'' shows the centre line of the shell in relation to the axis of the bore of the elevating mass at the maximum elevation, which e.g. can be 70°.

From FIG. 4, it will be noted that the front parts $30b_1$ of the shell 30 go clear of the elevating mass 2 when the firearm is at an elevation of zero. At this elevation the loading tray would thus not need to be set obliquely, but the front parts of the shell could extend over the elevating mass when the loading tray is set in the side position for receiving the shell in question from a loading table or the like. On the other hand, the front nose parts $30b_2$ would have struck the elevating mass 2 in the side position if the loading tray had not been set obliquely so that the front nose section of the shell could extend at the side of the elevating mass. It should be noted that the loading pendulum has swung up the loading tray to the position at the loading table regardless of the angle of elevation of the firearm.

The above utilizes a space savings of 200 to 600 mm in the longitudinal direction of the firearm, or firing with comparatively longer shells (length up to 1000 mm) can take place with the same space behind the firearm.

The invention is not limited to the embodiment shown above as an example, but can be subject to modifications within the scope of the following claims.

INDUSTRIAL APPLICABILITY

The parts comprised in the invention are simple and economic to manufacture in efficient production at a factory, and the loading pendulum with the loading tray can be manufactured separately or integrated with the manufacture of the firearm. In the former case, integration can take place with both new artillery pieces and pieces which are already in service.

We claim:

1. In a firearm having a gun barrel with loading chamber, a trunion rotatably supporting a loading pendulum, for assuming during ammunition loading of said firearm the elevation angle of said firearm, an apparatus for supporting a loading tray to said loading pendulum comprising:

a pair of arms connected at one of the ends thereof by first and second drive shafts to said loading pendulum, said arms extending perpendicular from said loading pendulum and thence in a forward direction of said firearm at first and second different angles, the remaining ends of said arms connected to said loading tray at first and second loading points; and driving means for rotating said drive shafts;

said loading tray in a first ammunition receiving position being supported obliquely to a vertical plane of said gun barrel, and, in response to rotation of said drive shafts, moving to a second ammunition delivery position coincident with the axis of the gun barrel and loading chamber.

2. The apparatus for supporting a loading tray of claim 1 wherein said arms are connected along the length of said loading pendulum, the distance between pivotted ends of the rear arm loading point and its drive shaft connected end being greater than the distance between the forward arm loading point and its drive shaft connected end.

3. The apparatus for supporting a loading tray of claim 2 wherein said distances differ by 10 mm to 50 mm.

4. The apparatus for supporting a loading tray of claim 2 wherein said distances differ by 20 mm to 40 mm.

5. The apparatus for supporting a loading tray of claim 2 wherein said distances differ by 25 mm.

6. The apparatus for supporting a loading tray of claim 1 wherein said arms are each comprised of a first length connected to said drive shafts, and a remaining length making an oblique angle with said first length, said remaining length of the rearward arm being longer than the remaining length of said forward arm.

7. The apparatus for supporting a loading tray of claim 6, whereby said first lengths are parallel to each other and extend at right angles to said vertical plane when said loading tray is in said ammunition receiving position, and said second lengths extend in a obliquely forward direction of said firearm, said arms being located entirely at the side of said firearm breech ring and directly rearwardly of the longitudinal direction of said firearm.

8. The apparatus for supporting a loading tray of claim 1 wherein one of said loading points is connected for displacement in relationship to the loading tray.

9. The apparatus for supporting a loading tray of claim 8 wherein said drive shafts are connected to each other with a tie rod.

10. The apparatus for supporting a loading tray of claim 9 wherein one of said drive shafts is connected to an operating cylinder, said driving cylinder displacing said tie rod where rotation of said drive shafts commence.

* * * * *